United States Patent [19]

Wheeler

[11] 4,170,382

[45] Oct. 9, 1979

[54] POSTURE CHAIR

[75] Inventor: Kenneth L. Wheeler, Elkhart, Ind.

[73] Assignee: Domore Office Furniture, Inc., Elkhart, Ind.

[21] Appl. No.: 807,907

[22] Filed: Jun. 20, 1977

[51] Int. Cl.[2] ..... A47C 7/40

[52] U.S. Cl. ..... 297/306; 297/353

[58] Field of Search ..... 297/306, 304, 305, 298, 297/296, 297, 353, 383

[56] References Cited

U.S. PATENT DOCUMENTS

| | | | |
|---|---|---|---|
| 252,980 | 1/1882 | Tonk et al. | 297/298 |
| 1,368,469 | 2/1921 | Atwood | 297/304 |
| 2,328,243 | 8/1943 | Wood | 297/306 |
| 2,329,327 | 9/1943 | Boerner | 297/304 X |
| 2,329,673 | 9/1943 | Wood | 297/305 |
| 2,570,177 | 10/1951 | Wood | 297/304 X |
| 3,034,828 | 5/1962 | Kurihara | 297/304 |
| 3,720,442 | 3/1973 | Bergmann et al. | 297/353 |

FOREIGN PATENT DOCUMENTS

| | | | |
|---|---|---|---|
| 441610 | 1/1936 | United Kingdom | 297/304 |

*Primary Examiner*—Francis K. Zugel

*Attorney, Agent, or Firm*—Gordon W. Hueschen

[57] ABSTRACT

A posture chair is provided with a spring-biased back in which the spring means is located underneath, adjacent to and substantially parallel with the bottom of the seat and in which the back is adjustable both vertically and rearwardly so that, when the back is adjusted upwardly to accomodate a larger person, it is simultaneously moved backward so that the depth of the seat is increased.

18 Claims, 8 Drawing Figures

POSTURE CHAIR

BACKGROUND OF THE INVENTION

1. Field of the Invention

The invention relates to posture chairs having a seat and a back provided with means for adjusting the height of the back and for permitting it to rock back and forth against spring-bias.

2. Prior Art

Various posture chairs as just described are known in the art. See, for example, U.S. Pat. Nos. 2,018,825; 2,158,453; 2,257,583; 2,328,243; 2,329,673; and, 2,570,177. All of these show the back mounted for rocking back and forth against the compression springs enclosed in a tube or pipe. These prior art devices suffer the disadvantages, however, that, the spring pipes are either mounted alongside the seat and thus exposed, or require a specially modified seat to accomodate the pipe springs; that, the spring pipes are individually attached to separate back support members located at the sides of the back portion, with the result that when a greater load is applied to one side of the back portion, correspondingly greater tension will be placed on the spring on that side of the chair; that, the pipe springs are attached by a single projecting bolt or lug which is placed under torque and in single shear when the spring pipe is loaded; that, adjustment of the height of the back involves multiple adjustment, an adjustment for each of the side supports or an adjustment at each end of the spring pipe; that, in all of the prior art devices except those of the said U.S. Patents, the force with which the back pushes back increases the farther it is pushed back, whereas in the devices of the cited U.S. Patents, the opposite is the case, namely, the force decreases, but in that case it decreases to such an extent that it is frequently difficult for a person to right himself without undue strain on his abdominal muscles; that, simultaneous single-control adjustment of the height of the back and the depth of the seat, where possible, does not provide adequate seat-depth adjustment.

OBJECTS OF THE INVENTION

It is an object of the invention to provide an improved posture chair. It is a further object of the invention to provide a posture chair in which the back support means can be spring-loaded without the necessity of altering or modifying the seat of the chair to accommodate the spring means for biasing the back of the chair. It is a further object of the invention to provide a posture chair of improved aesthetic value. It is a still further object of the invention to provide a posture chair in which the height of the back can be simply and effectively adjusted. Also, it is a further object of the invention to provide a posture chair in which, on adjustment of the height of the back portion of the chair, the depth of the seat is simultaneously and proportionally adjusted without increasing or decreasing the spring tension. It is a further object of the invention to provide a posture chair in which the load placed on the spring pipes is evenly distributed independently of the side of the back to which the load is applied. It is still a further object of the invention to provide a posture chair in which the spring pipes have double-shear, non-torque mountings. It is a further object of the invention to provide a posture chair in which the back pressure exerted by the back more closely meets human requirements than the prior art devices. It is still a further object of the invention to provide a posture chair in which the force required to push the back backward decreases as the back is pushed backward, but not to an extent greater than about 15 percent. Other objects of the invention are to avoid the disadvantages of the prior art and to obtain such advantages as will appear as the description proceeds.

BRIEF DESCRIPTION OF THE INVENTION

The invention is directed to a posture chair having a seat, a back, means for allowing the back to move back and forth, and means to spring-bias the back against backward movement, comprising back support means having its upper portion affixed to the back and supporting the back in a position to be engaged by a person's back and its lower portion extending substantially below the bottom of the seat, pivot means located substantially below the bottom of the seat for pivotally connecting the lower portion of the back support means thereto, thereby to permit the described back-and-forth motion, and spring means for biasing the back support against backward motion, which spring means has one end attached to the bottom of the seat adjacent the front thereof, and the other end attached to the back support means below and adjacent the bottom of the seat so that the spring means extends below, adjacent to, and substantially parallel with the bottom of the seat.

Advantageously, the lower portion of the back support means has an adjustable slide connection for adjusting the effective length of the back support so that the height of the back can be adjusted as desired.

Advantageously, the adjustable slide connection comprises a yoke having its bottom journaled to the pivot means, its top pivotally connected to the rearward end of the spring means, its rear or back portion having receiving means for slidably receiving the lower portion of the back support means, and locking means for locking the lower portion in the receiving means in any of several different positions as may be desired. Advantageously, the lock means comprises a set screw having an enlarged head for manual operation.

In a preferred form of the invention, the back support means has a lower portion which projects underneath the bottom of the seat at an angle thereto, advantageously at an angle of about 45 degrees, say between about 40 and 50 degrees, to the bottom of the seat. Advantageously, this lower portion of the back support means which angles underneath the bottom of the seat has an adjustable slide connection with the yoke for adjusting the effective length of the lower portion so that adjustment of the back upwardly, simultaneously and proportionately moves it backwardly. This effectively enlarges the depth of the seat as the height of the back is raised. The angle is chosen according to how much enlargement of the seat is desired for each unit increase in height of the back. Thus, an angle of 40 degrees gives a proportionately larger increase in seat depth than an angle of 50 degrees.

Also, in this modification, the adjustable slide connection advantageously comprises tilt means as described above. This tilt means comprises the afore-mentioned yoke having its bottom portion journaled to the pivot means comprising a bracket affixed to the bottom of the seat and its top portion pivotally affixed to the spring means. The yoke has a channel or slot for receiving the lower portion of the back support means which angles underneath the seat in a slide connection, so that the lower portion of the back support means can be slid in and out of the yoke and fastened therein in any desired position by the set screw.

It will be understood, of course, that the spring pipe constitutes a limiting means which limits the extent to which the back portion can be moved back. Either it is provided with suitable stop means or else it is so designed that the coil spring therein goes solid and thus effectively prevents further extension of the pipe spring. The details of the construction of the pipe spring are generally well known in the art and it is a combination thereof, with the structure above-described, that constitutes the essence of the invention in its preferred embodiment.

Advantageously, there will be two spring pipes; one on each side of the seat, and the yoke will extend from one side to the other and the back support means will be connected thereto at an intermediate point between the spring pipes. It will be understood, however, that more than two spring pipes can be used, if desired. The yoke has its bottom portion journaled to depending arms of a bracket affixed to the bottom of the seat and its top portion journaled or pivotally connected with the rearward end of the spring pipes. The bracket is far enough under the chair seat that the center line connecting the two pivot points forms an angle of about 55 degrees, say, between about 50 degrees and about 60 degrees, with the bottom of the seat, or, with the spring pipe, which is parallel with the bottom of the seat. When a person sits on the seat and leans back, a perpendicular or horizontal force is exerted on the back. This force creates a turning moment in the yoke about the point where it is pivoted to the bracket. This turning moment, in turn, places the spring pipe under tension and causes a back force to be applied through the back to the torso of the person sitting in the chair. This force depends upon the tension and strength of the spring in the spring pipe. A spring of suitable strength will accordingly be incorporated in the spring pipe and means for adjusting the tension provided. In addition to the above-mentioned perpendicular force, if the seat is padded or cushioned, there is a natural vertical force resulting from the movable weight of the upper torso, due to the cushioning in the seat. Thus, the force applied to the back by the person sitting in the chair has both horizontal and vertical components or vectors, which create a variable moment about the chair back pivot point. The angular relation of the pivot point center line, with regard to the bottom of the seat, or, with regard to the spring pipes, is such that, as the combination of the above forces pushes the back backward, the back force applied to the person's torso is gradually reduced. The design is such, however, that the amount of reduction in the back force does not exceed about 15 percent when the full backward position is reached. Thus, by adjusting the tension of the spring pipes to the weight of the person using the chair, the person can rock to the backward position and remain there without having to exert any additional force other than that engendered by his weight and, at the same time, the back force exerted by the spring pipes is such that the person can right the chair to the full forward position without undue stress on his abdominal muscles.

A characteristic feature of the invention is that the means, for spring-biasing the back, is wholly located underneath the seat portion, and does not require modification of a normal seat structure. Thus, the pipe springs, in accordance with the invention, extend along and underneath the bottom of the seat and parallel thereto where they are hidden from normal viewing. Also, the construction of the invention provides for easy adjustment of the height of the back and, in the preferred form of the invention, for simulataneous and proportionate adjustment of the seat depth.

In the broader aspect of the invention, a posture chair is contemplated in which the spring means for biasing the back support against backward motion comprises spring pipes having one end journaled to a clevis pin affixed to the front bottom portion of the seat and the other end journaled to a clevis pin affixed to the back support means.

Also, in a broader and more particular aspect of the invention, a posture chair is contemplated having a bracket fastened underneath the bottom of the seat having clevis yokes adjacent the front edge thereof and depending arms adjacent the back thereof, a back support means comprising a supporting yoke having, adjacent the bottom portion thereof, clevis yokes straddling said arms and pivotally connected thereto by a clevis pin and, adjacent the top portion thereof, clevis yokes complementary with the clevis yokes on the front portion of the bracket with spring pipes having opposite ends journaled in clevis pins in the complementary clevis yokes.

In still another broader and more particular aspect of the invention, a posture chair is contemplated having a seat supporting bracket which comprises an integral flat member adapted to be affixed to the bottom of the seat having a center rectangular portion with an integral hub in the center thereof adapted to receive the spindle of a chair supporting means or frog, integral first clevis yokes in the forward portion of the flat member, integral depending arms in the rearward portion of the flat portion having clevis pin-receiving holes in the ends thereof, a supporting yoke having second clevis yokes complementary with the depending arms and third clevis yokes complementary with the first clevis yokes, with the supporting yoke being pivotally connected with the supporting bracket by a means of first clevis pins connecting the second clevis yokes to the depending arms through the celvis pin-receiving holes therein, spring pipes having clevis pin-receiving holes in the opposite ends thereof which are pivotally connected by means of second clevis pins to complementary pairs of the first and third yokes, the spring pipes being tensioned to hold the supporting yoke in the forward position and to allow it to rock back about the first clevis pins as a pivot point, adjustable back support-receiving means in the yoke, and back supporting means adapted to be received by said back support-receiving means, whereby when a primary force is applied to the back, the force is transmitted to the spring pipes and the supporting yoke is caused to rock back against the spring tension of the spring pipes and a corresponding back force is applied to the back.

BRIEF DESCRIPTION OF THE DRAWINGS

In the drawings:

FIG. 4 is a side elevation of a spring pipe with parts broken away to show details of construction.

DETAILED DESCRIPTION OF THE INVENTION

Figure 1:
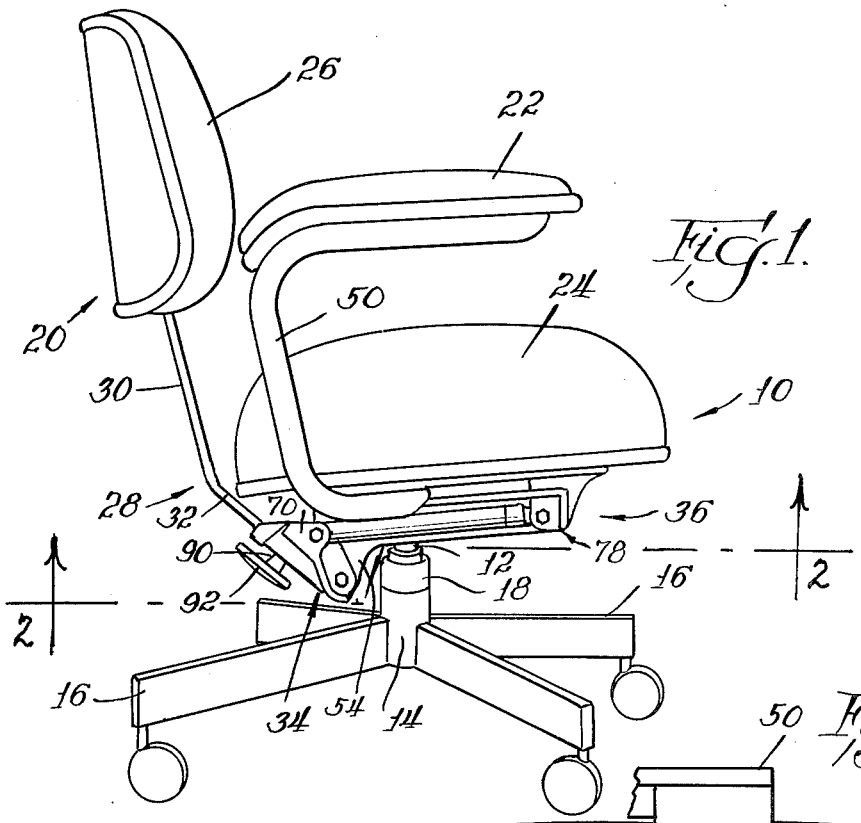
FIG. 1 is side elevation of a posture chair according to the invention.
Figure 2:
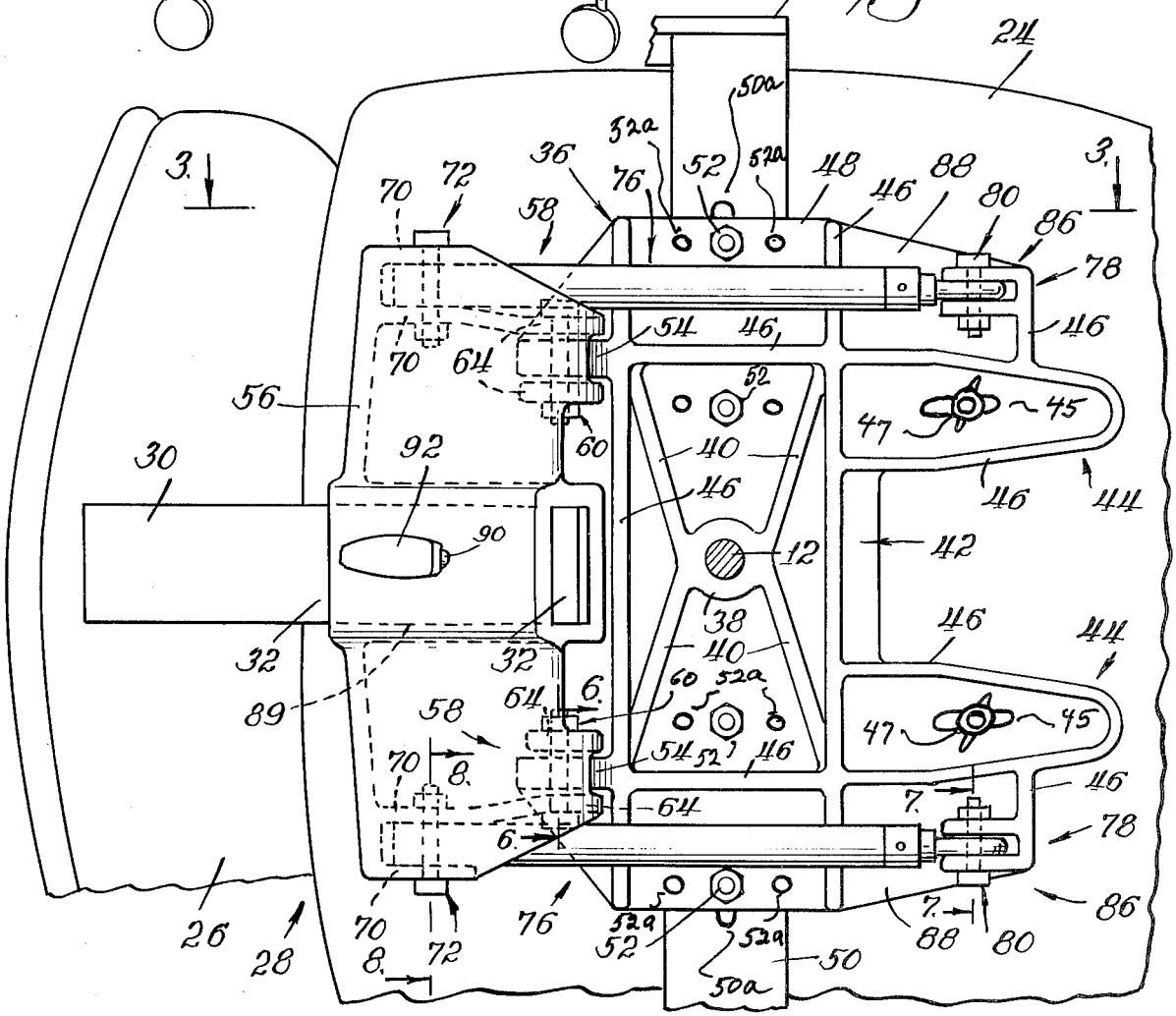
FIG. 2 is a view taken along line 2—2 of FIG. 1.
Figure 3:
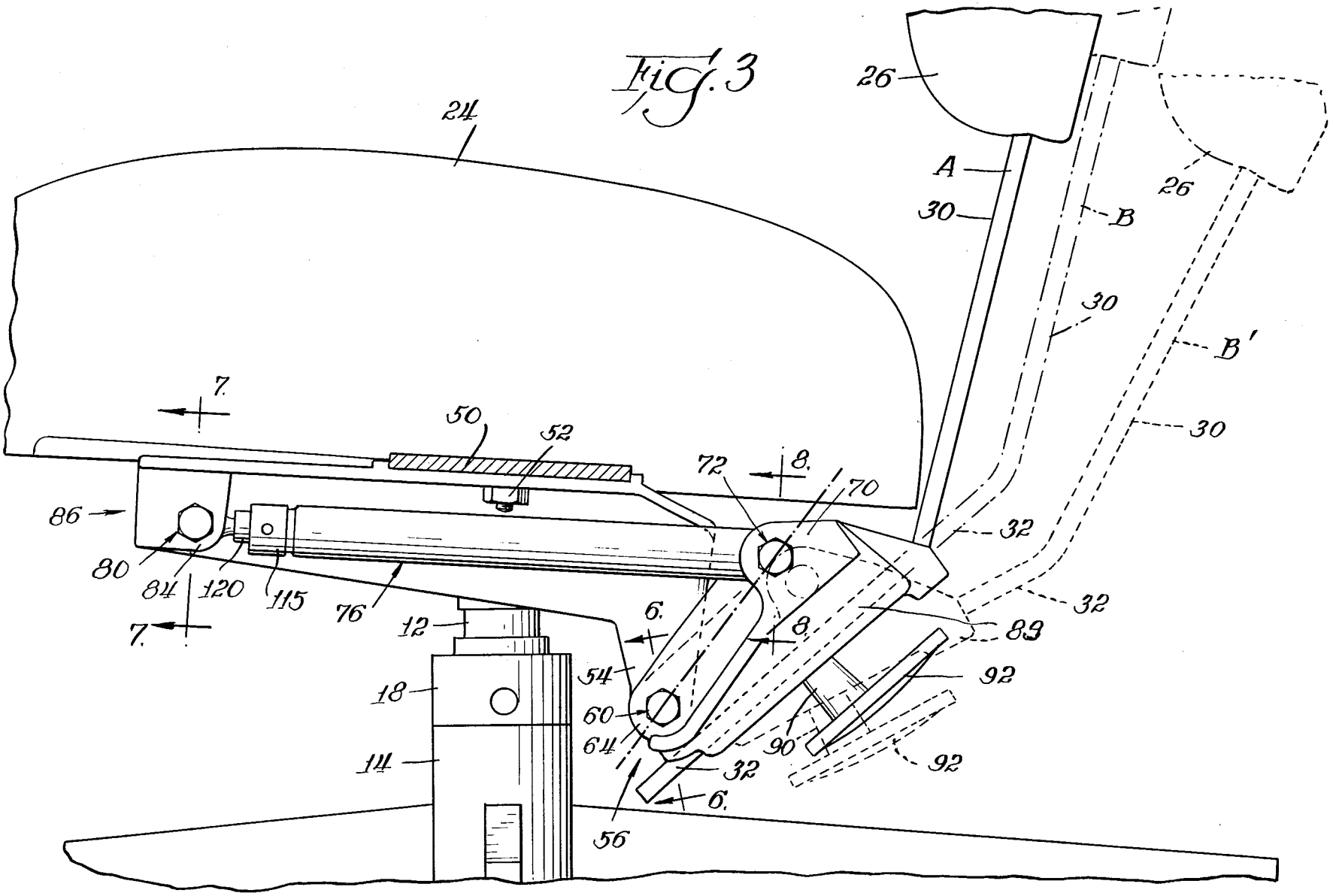
FIG. 3 is a side elevation in greater detail.
Figure 11:
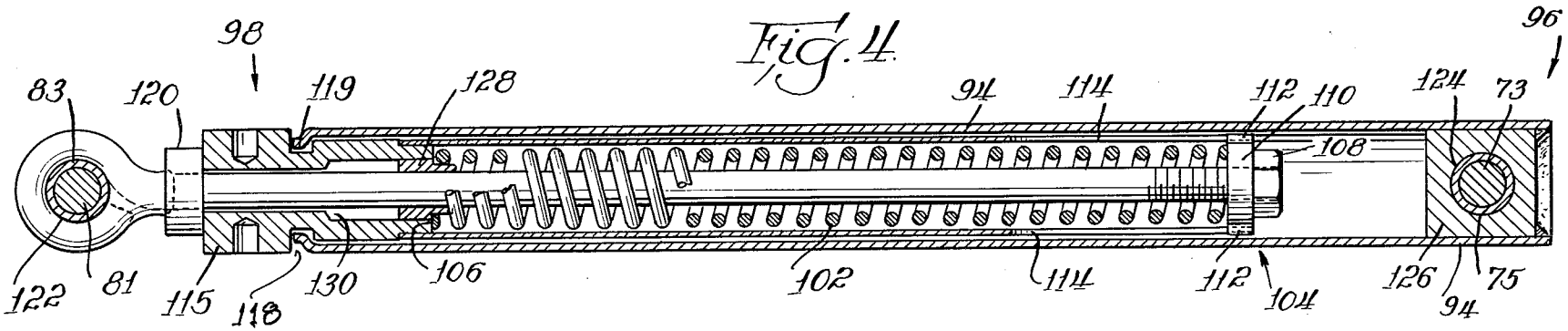
Figure 5:
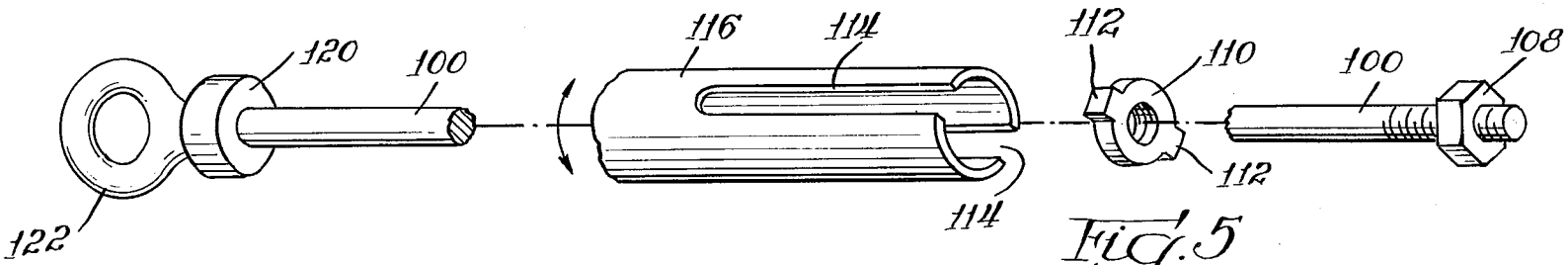
FIG. 5 is an exploded view showing details of the construction of FIG. 4.

In FIG. 1 there is shown a posture chair according to the invention having a seat 10 supported by a vertical member or spindle 12 journaled in the hub 14 of the frog or chair base 16. The vertical member has a collar 18 affixed thereto adapted to rest on the hub 14. Thus, the chair can be rotated about the vertical axis comprising the vertical member 12 and the hub 14.

The chair has a back 20 adapted to rock back and forth as will be presently described and, if desired, arm rests 22. The seat 10 has a padded portion 24 and the back 20 has a padded portion 26 located to support the back of the person sitting in the chair.

The back member 20 is supported by back supporting means 28, which comprises a flat bar bent at an obtuse angle to provide an upper portion 30, a lower portion 32, and is provided with means 34 for pivoting the back support member to the seat.

Fastened to the bottom of the seat on the underneath side thereof is a bracket 36 having a hub or socket 38 for receiving the vertical member 12 and securing it to the seat with a strong rigid connection. For this purpose, the bracket 36 is provided with reinforcing members 40 which angle upwardly from the four corners of the rectangular central portion 42 of the bracket 36 to the hub 38, thereby providing a strong rigid structure.

It will be understood that the collar 18 and the vertical member 12 may have complementary threads so that, by turning the collar 18, the height of the chiar can be adjusted. Also, it is to be understood that there may be bearings between the collar 18 and the hub 14 to facilitate easy rotation.

The bracket 36 has forwardly projecting arms 44 projecting out under the seat toward the front. These arms and the rectangular portion 42 having dished-out portions and upstanding edges 46 to provide maximum regidity with a minimum weight.

Projecting laterally from the rectangular portion 42 are flat portions 48 also having upstanding ribs 46 to which the arm rest supports 50 are attached by bolts 52 or other suitable attaching means.

Projecting from the rear of the rectangular portion 42 are two parallel depending arms 54 on which a supporting yoke 56 is pivoted. The pivotal connection is effected by means of the clevis yoke 58 having clevis pin 60 projecting therethrough and projecting through a hole 62 in the arm 64 of the clevis yoke 58 and through a complementary hole 66 in the depending arm 54. Details of this structure are best seen in FIG. 6.

The supporting yoke 56 is suitably a casting in which the yoke arms 64 are formed integrally therewith as are other features of the yoke which will be described.

Figure 8:
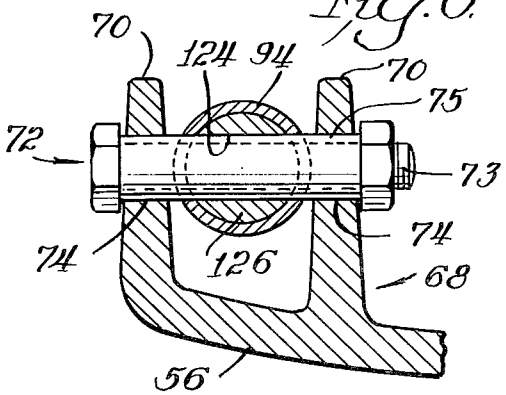
FIG. 8 is a partial section taken along line 8—8 of FIG. 2.
Figure 6:
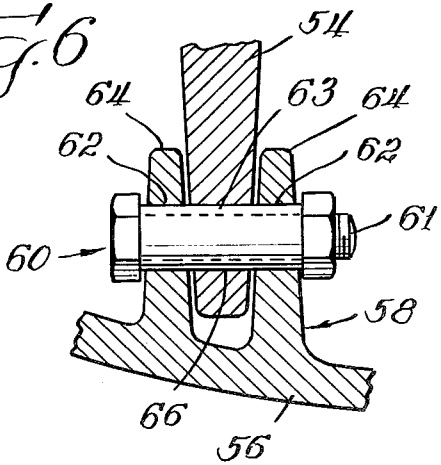
FIG. 6 is a partial section taken along line 6—6 of FIG. 2.
Figure 7:
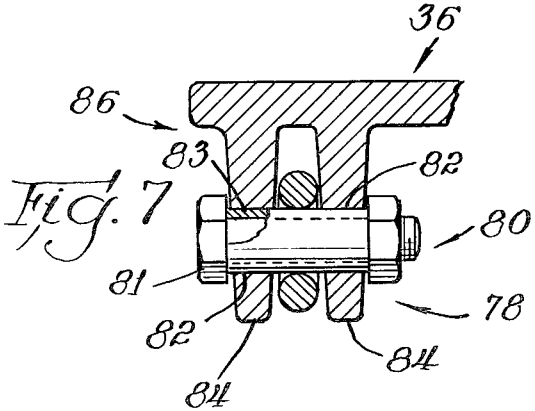
FIG. 7 is a partial section taken along line 7—7 of FIG. 2.

The yoke is generally an elongated rectangular piece which has its bottom edge pivotally fastened to the bracket 36 by the clevis pin arrangement shown in FIG. 6 and its upper ends provided with clevis yokes 68 having arms 70 and clevis pins 72 projecting through holes 74 in the arms 70. (See FIG. 8.)

Journaled on the clevis pin 72 is the closed end 96 of the spring pipe 76, shown in FIG. 4. The opposite end 98 of the spring pipe 76 is journaled on a clevis pin 80 passing through holes 82 in arms 84 of clevis yoke 86, formed as integral portions of the bracket 36.

Extending laterally from the flat portion 48 and the extending arms 44 is a forward flat portion 88. The clevis yoke 86 is formed as an integral portion of the forward part of the flat portion 88. The clevis yoke 78 is aligned with the complementary clevis yoke 68 so that the spring pipe 76 on one side of the chair is parallel with the spring pipe on the other side of the chair.

The yoke 56 has in its inner portion a slot or channel 89 complementary with the lower portion 32 of the back, which can be slid in and out of the channel or slot 89. There is provided in the channel or slot 89 a set screw 90 having an enlarged handle 92 so that the lower portion 32 can be fixed therein in whatever position it has been inserted, but also so that by loosening the screw the lower portion 32 can be pushed in or pulled out as desired and be set in the new position. Thus, the effective length of the back support member 28 can be increased or decreased and in turn the height of the back 20 increased or decreased.

It will be seen from the above description that a force applied to the back 20 will cause the back to rock backwards about the clevis pins 60 as a pivot point and against the spring action of the spring pipes 76 which connect the clevis pins 72 and 80.

The spring pipe, as best seen in FIG. 4, comprises a tubular member or pipe 94 having a closed end 96 and an open end 98. Projecting into the open end 98 is a rod 100 adapted to reciprocate in and out of the tube 94. Between the tube 94 and the rod 100 is a coil spring 102, one end of which abuts the stop 104 at the rear end of the rod 100 and the other end of which abuts the stop 106 which is adjacent the inner end of the tube 94.

The stop means 104 comprises a nut 108 which is threaded on the end of rod 100. By adjusting this nut, the tension that the spring is under can be increased or decreased to give the desired initial setting. The stop 104 also comprises the winged nut 110 which is adapted to be moved on the aforementioned threads inwardly to place the spring under greater tension. The wings 112 of the winged nut 110 are adapted to fit the slots 114 of an inner tube 116 which is inserted in the tube 94 between it and the coil spring 102. By rotating this tube, the nut can be advanced or retracted along the aforementioned threads.

The tube is affixed to the stop means 106, which in turn passes through the open end 98 of the tube 94 and terminates in an adjusting wheel 115. An annular slot 118 is provided between the stop 106 and the adjusting wheel 115 and the ends 119 of the tubular member are swaged into this annular slot 118 so that the rotating wheel 115 and the stop 106 can be rotated but will nonetheless be held firmly in the position shown with relation to the tube 94. Since the inner tube 116 is affixed to the stop 106, rotation of the wheel 115 will thus cause the winged plug 110 to move forward or backward according to the direction of the rotation.

A collar 120 is mounted on the rod 100 and adapted to abut the adjusting wheel 115. Hence, the distance between the center of the hole or eye 122 in the end of the rod 100 and the hole 124, at the opposite end of the tube 94, remains constant. Advantageously, the hole 124 is bored through a plug 126, welded in the end of the tube 94.

The extent that the rod 100 can be withdrawn from the tube 94 is limited by the spring 102. When this spring goes solid, the rod cannot be drawn forth further. It is an advantage, however, to provide an independent stop means which comprises a collar 128 welded on the rod 100 and adapted to abut a suitable portion 130 of the stop 106. Thus, the extent that the rod 100 can be withdrawn from the spring pipe is determined by the space between the collar 128 and the abutment 130. For this purpose, the stop 106 has an internal bore enough larger than the rod 100 to accommodate the collar 128.

The clevis yoke 78 and the clevis pin 72 are so located that, in the upright position, the spring pipe 76 is essentially parallel with the bottom of the seat and the clevis yoke 58 and clevis pin 60 are so located that the center line between the pivot points determined by the clevis pins 60 and 72 form an acute angle with the bottom of the seat or with the pipe spring 76. This angle, advantageously, is about 55 degrees but can be larger or smaller, say, between about 50 degrees and about 60 degrees. The angle is a critical one because, when force is applied to the back by a person sitting in the chair, the back force engendered by the spring pipe 76 gradually decreases as the back is moved backward but not to an extent greater than 15 percent of that initially required. When the angle is too large, the back force engendered by the pipe spring 76 will be so great that it increases as the back is pushed backward and, if the angle is too small, the extent to which the back force is decreased will be so great that it is difficult for a person to regain the upright position. This indeed is the condition which obtains in some chairs, for example, those according to U.S. Pat. No. 2,328,243. The other condition, that is where the back force increases, is characteristic of most other chairs. In other chairs, such as those illustrated in U.S. Pat. No. 2,329,673, the angle is adjustable, so that a variety of conditions could be obtained, some of which might approximate the optimum conditions of this invention, but in those, they are obtained only by a change in the height of the back and/or the position in which the pipe spring is pivoted to the chair seat.

In accordance with the invention, the optimum conditions are built in and inherent in the structure and are complemented by all other adjustments, which are made only for purposes of fine tuning the device.

The factors which effect the optimum conditions are the weight of the person sitting in the chair, coupled with his height, which determines the leverage applied to the back support member 20 according to the position of the pad 26. However, this condition is compensated by adjusting the tension on the coil spring 102 by turning the adjusting wheel 115 to tighten up the spring for a heavier person or to loosen up the spring for a lighter person. When a person sits in the chair, a horizontal or perpendicular thrust (perpendicular to the pad or back rest 26), is applied to the back support member 20, causing it to rock back against the pressure of the coil spring 102. When the tension on the coil spring is properly adjusted to the weight and height of the individual, the optimum conditions are obtained in which the back force gradually diminishes as the back is pushed backward, but never to an extent more than 15 percent of the initial force. Concomitantly, with the application of the horizontal force, there is also applied a vertical component. Thus, as a person leans back against the back rest 26, there is applied a force which has both a vertical and a horizontal component. The design of the chair according to the invention, in which the pipe springs are substantially horizontal to the bottom of the seat and the center line between the two pivot points formed by the clevis pins 60 and 72 forms an angle between about 50 degrees and about 60 degress, preferably about 55 degrees, is such as to give the optimum conditions described.

The back support means 28 extends downwardly to a point adjacent the back edge of the seat and then inwardly at an angle to a point underneath the seat. In other words, the upper portion 30 extends downwardly at a slight angle to the vertical toward the bottom of the seat and the lower portion 32 extends at a greater angle underneath the seat into the channel or slot 89 in the yoke 56. The angle formed by the upper portion 30 and the lower portion 32 is obtuse, so that the back rest 26 will be far enough back of the seat. Suitably, the angle can be about 140 degrees to about 150 degrees. Thus, when the lower member 32 is pushed out of the slot or channel 89 from the position shown at A to the position shown at B, the back rest 26 is simultaneously raised and moved backward. Thus, when the back rest is adjusted to fit a larger person, the depth of the seat is simultaneously increased to accommodate such a person. Advantageously, the lower member 32 angles in under the seat at an angle of about 45 degrees. It will be understood, however, that it can be larger or smaller and that the smaller it is, the greater will be the depth of the seat adjustment, and vice versa. Ordinarily, however, it will not be necessary to have the angle less than about 40 degrees or greater than about 50 degrees. Within these limits, the back rest can be raised and simultaneously moved backward to accommodate persons of different torso lengths, and to give them more seat room without taking them off the cushion or pad. Advantageously, the stop in the spring pipe 76 is arranged to limit the angle through which the back can be rocked backward to not more than about 13 degrees. It will be understood, however, that the angle can be more or less than this, but, advantageously, it is not advisable to exceed about 15 degrees nor to go below about 10 degrees.

It will be thus seen that the invention provides a posture chair which provides a simple and effective adjustment to meet a person's needs according to height and weight by simultaneously increasing the height of the back rest and the depth of the seat together with a simple adjustment for altering the spring pressure to maintain the back force within the desired limits in which the back force decreases gradually as the back is moved backward, but not to the extent of more than about 15 percent of the initial force applied.

The bracket 36 is fastened to the underside of the seat 10 by means of bolts with wing nuts 47 projecting through the longitudinal slots 45 in the arms 44. Additional forward and backward adjustment of the seat is thus provided for. Transverse adjustment of the arm supports 50 is also provided by the transverse slot **50*a* and forward and backward adjustment by the holes 52*a* adapted to receive the bolts 52**.

It is to be understood that the invention is not to be limited to the exact details of operation or structure shown and described, as obvious modifications and equivalents will be apparent to one skilled in the art.

I claim:

1. In a posture chair having a seat having a supporting spindle, a back, means for allowing said back to move back and forth, and means to spring-bias said back against backward movement, the combination of a bottom member, underlying said seat, which bottom member is essentially flat throughout its length and breadth;

supporting plate means fastened to the underside of said bottom member supported by said spindle and extending over the areas of said bottom member which are to the front and rear of and on each side of said spindle;

pivot support means depending from the portion of said supporting plate which extends over the area to the rear of said spindle;

pivoted means pivoted to said pivot support means on a transverse axis which is parallel to and substantially below said bottom member and adjacent and parallel to the rear edge thereof;

back support means having an upper portion and a lower portion, said upper portion being affixed to said back and supporting said back in position to be engaged by a person's back and said lower portion extending substantially below the bottom of said seat and being affixed to said pivoted means, thereby to permit the aforesaid back and forth motion;

spring means for biasing said back support means against backward motion, said spring means having one end attached to the portion of said supporting plate means which extends under the area of said bottom which is in front of said spindle and the other end pivotally attached to said pivoted means below and adjacent to the bottom of said seat and substantially above and to the rear of said transverse axis, whereby said spring means extends below, adjacent to, and substantially parallel with the bottom of said seat; in which the upper portion of said back support means extends down to a position adjacent the back bottom edge of said seat and the lower portion projects underneath the seat at an obtuse angle to said upper portion, and at an acute angle to the bottom member of said seat; in which said pivoted means comprises receiving means for adjustably receiving the lower portion of said back support means operative on said acute angle to adjust the said back support means backward and upward, whereby the height of said back can be adjusted and simultaneously therewith, due to the angularity of said lower portion of said back support means, the seat depth can be proportionally adjusted; and in which said pivoted means comprises yoke means having an elongated, substantially flat portion, the bottom ends of which are pivoted in said pivot support means, the top ends of which are pivoted to said spring means, and the mid-portion of which is provided with said receiving means, said receiving means angling from a point adjacent the rear edge of the bottom member of said seat at an angle complementary to the acute angle at which the lower portion of said back support means projects underneath the bottom of said seat, in which the center line, through the point at which the spring means is pivotally connected to said yoke and the point at which said yoke is pivotally connected to said pivot means, subtends an angle of about 50 degrees to about 60 degrees with the bottom of said seat, and in which said receiving means, in the forward position of the back, forms an angle with the bottom member of said seat of between about 40 and about 50 degrees.

2. The posture chair of claim 1, in which said first named angle is about 55 degrees and said second named angle is about 45 degrees.

3. In a posture chair having a seat, a back, means for allowing said back to move back and forth, and means to spring-bias said back against backward movement, the combination of a bottom member, underlying said seat, which bottom member is essentially flat throughout its length and breadth and has front, rear, and side portions;

supporting plate means fastened to the underside of said bottom member and extending over a portion of each of said front, rear, and side portions of said bottom member;

pivot support means depending from the portion of said supporting plate which extends over the rear portion of said bottom member;

pivoted means pivoted to said pivot support means on a transverse axis which is parallel to and substantially below said bottom member and adjacent and parallel to the rear edge thereof;

back support means having an upper portion and a lower portion, said upper portion being affixed to said back and supporting said back in position to be engaged by a person's back and said lower portion extending substantially below the bottom of said seat and being affixed to said pivoted means, thereby to permit the aforesaid back and forth motion; and, spring means for biasing said back support means against backward motion, said spring means having one end attached to the portion of said supporting plate means which extends under the front portion of said bottom member and the other end pivotally attached to said pivoted means below and adjacent to the bottom of said seat and substantially above and to the rear of said transverse axis, whereby said spring means extends below, adjacent to, and substantially parallel with the bottom of said seat, in which the spring means comprises spring pipes, and in which one end of each spring pipe is disposed in the fork of a clevis affixed to the portion of said supporting plate means which extends over the front portion of said bottom member and is journaled to the clevis pin thereof and the other end is disposed in the fork of a clevis affixed to said pivoted means and journaled to the clevis pin thereof.

4. In a posture chair having a seat, a back, means for allowing said back to move back and forth, and means to spring-bias said back against backward movement, the combination of back support means having an upper portion, a lower portion, and a pivoted means, to which said lower portion is slidably attached, said upper portion being affixed by said back and supporting said back in position to be engaged by a person's back and said lower portion and said pivoted means extending substantially below and under the bottom of said seat at an acute angle;

pivot support means having a transverse axis located substantially below the bottom of said seat with said axis parallel and adjacent to the rear edge thereof for pivotally connecting the said pivoted means thereto, thereby to permit the aforesaid back and forth motion; and, spring means units for biasing said back support against backward motion, each said spring means unit comprising a spring pipe having one end journaled by a first clevis pin in the fork of a first clevis affixed to the front bottom portion of said seat and the other end journaled by a second clevis pin in the fork of a second clevis affixed to said pivoted means, said second clevis pins being aligned on a transverse axis which is parallel with the axis of said pivot support means and displaced farther to the rear.

5. A posture chair comprising a seat, a back, a bracket fastened underneath the bottom of said seat having a clevis yoke adjacent each front side edge thereof and a depending arm adjacent each rear side edge thereof, back support means comprising a supporting yoke having adjacent each end of the bottom portion thereof a clevis yoke straddling said depending arms and pivotally connected thereto by clevis pins and, adjacent each end of the top portion thereof, a clevis yoke complementary with the clevis yokes on the front side portions of said bracket, spring pipes having opposite ends journaled by clevis pins in the complementary clevis yokes, and a back supporting member projecting rearwardly and upwardly from said supporting yoke, and adjustable fastening means for fastening said back supporting member to said supporting yoke.

6. The posture chair of claim 5, in which the bracket and supporting yoke are separate unitary castings.

7. The posture chair of claim 5, in which the back supporting member is a flat bar which has an elongated upper portion and a straight lower portion bent at an obtuse angle to the upper portion, said lower portion projecting under the bottom of said seat at an acute angle thereto

8. The posture chair of claim 7, in which said adjustable fastening means comprises a slot complementary to said straight lower portion and in which said straight lower portion is slidable in and out, whereby adjustment of said lower portion in and out of said fastening means adjusts both the height of the back and the depth of the seat.

9. The posture chair of claim 7, in which the lower portion forms an angle of about 40 degrees to about 50 degrees with the bottom of said seat.

10. The posture chair of claim 9, in which said straight lower portion forms an angle of about 45 degrees with the bottom of said seat.

11. The posture chair of claim 7, in which the center line connecting the point at which the supporting yoke is pivoted to said arms and the point at which the supporting yoke is pivoted to said spring pipes forms an angle of about 50 degrees to about 60 degrees with the bottom of said seat.

12. The posture chair of claim 11, in which the angle is about 55 degrees.

13. In a posture chair having a seat, a back, and a chair support comprising a spindle, the combination therewith of a seat supporting bracket comprising an integral flat member adapted to be affixed to the bottom of the seat of said chair having a centrally disposed rectangular portion with a hub in the center thereof adapted to receive such spindle;

an integral first clevis yoke at each of the forward side portions of said flat member;

an integral depending arm at each of the rearward side portions of said flat member and having clevis pin-receiving holes in the ends thereof;

a supporting yoke having at each bottom side edge thereof a second clevis yoke integral therewith which is complementary with each of said depending arms and, at each top side edge thereof, a third clevis yoke complementary with each of said first clevis yokes, said supporting yoke being pivotally connected with said supporting bracket by means of first clevis pins connecting said second clevis yokes to said depending arms through the clevis pin-receiving holes thereof;

spring pipes having clevis pin-receiving holes in the opposite ends thereof, which pipes are pivotally connected in complementary pairs to said first and said third clevis yokes by means of second and third clevis pins in the clevis pin-receiving holes in the ends of said spring pipes, said spring pipes being tensioned to hold the supporting yoke in the forward position and to allow it to rock back about said first clevis pins as a pivot point; and adjustable back support-receiving means in said yoke and back support means adapted to be received by said back support-receiving means and adapted to transmit force applied to said back to said yoke whereby, when a primary force is applied to said back, the force is transmitted to said spring pipes and the supporting yoke is caused to rock back against the spring tension in said spring pipes and a corresponding back force is applied to said back.

14. The posture chair of claim 13, in which the center line connecting the point at which the supporting yoke is pivoted to said arms and the point at which the supporting yoke is pivoted to said spring pipes forms an angle of about 50 degrees to about 60 degrees with the bottom of said seat.

15. The posture chair of claim 14, in which the angle is about 55 degrees.

16. The posture chair of claim 14, in which the back support means has a lower portion which angles in under the chair seat into said adjustable back support-receiving means at an angle, when the back is in the forward position, of about 40 degrees to about 50 degrees with the bottom of said seat.

17. The posture chair of claim 16, in which the first angle is about 55 degrees and the second angle is about 45 degrees.

18. The posture chair of claim 17, in which the parts are so located that said primary force is greater than said back force and gradually diminishes as the back is pushed back, but not to an extent that the reduction of the back force exceeds about 15 percent when the full backward position is reached.

* * * * *